US006119879A

United States Patent [19]

Acchione

[11] Patent Number: 6,119,879

[45] Date of Patent: Sep. 19, 2000

[54] PASTA DRYING RACK MOUNTABLE AS A FIXTURE IN A KITCHEN

[76] Inventor: Lawrence Acchione, 7 Golfside Dr., St. Clair, Mich. 48079

[21] Appl. No.: 09/184,904

[22] Filed: Nov. 3, 1998

[51] Int. Cl.[7] ..... A47H 1/00; A47F 7/00; A47F 5/08; A47F 5/12; E05D 11/06

[52] U.S. Cl. ..... 211/99; 211/85.4; 211/100; 211/116; 211/171; 312/248; 16/359; 16/361

[58] Field of Search ..... 211/99, 104, 61, 211/96, 100, 116, 85.4, 171; D7/388; D32/58, 59; 312/245, 248; 16/357, 358, 359, 361; 403/59, 200

[56] References Cited

U.S. PATENT DOCUMENTS

| | | | |
|---|---|---|---|
| D. 140,187 | 1/1945 | Aaronson | D32/58 |
| D. 267,768 | 2/1983 | Duggan | D7/76 |
| 357,188 | 2/1887 | Edmondson | 16/345 |
| 1,263,216 | 4/1918 | Everitt | 211/100 X |
| 2,584,173 | 12/1947 | Van Fowler | 16/357 X |
| 5,105,954 | 4/1992 | Dahlquist | 211/195 |
| 5,167,329 | 12/1992 | Wilhite | 211/49.1 |
| 5,213,221 | 5/1993 | Raye, Sr. | 211/195 |
| 5,758,782 | 6/1998 | Rupert | 211/99 |
| 5,784,732 | 7/1998 | Vail | 16/361 X |
| 5,871,107 | 2/1999 | Johnson et al. | 211/104 |

OTHER PUBLICATIONS

Chef's Catalog, Dallas, Tx 75262–0048, Holiday 1998, p. 73, "The Best Pasta Drying Rack!".

*Primary Examiner*—Daniel P. Stodola
*Assistant Examiner*—Erica B. Harris
*Attorney, Agent, or Firm*—Christopher John Rudy

[57] ABSTRACT

A rack useful for drying pasta includes a mountable base member; at least one pivoting member connected to the base member and dependable therefrom, the at least one pivoting member being elongate with two opposing ends, about a first opposing end of which being pivotable with respect to the base member; and a service member connected to the at least one pivoting member at a point away from the first opposing end. The rack may be mounted as a fixture, particularly in a kitchen. A method of drying pasta includes providing a supply of raw pasta noodles, the supply being a plurality of the noodles generally parallel one to another; inserting a pasta rack dowel under the noodle supply; lifting the noodle supply with the dowel, and securing the same by a dowel retaining feature on a service member of a pasta drying rack.

20 Claims, 1 Drawing Sheet

PASTA DRYING RACK MOUNTABLE AS A FIXTURE IN A KITCHEN

BACKGROUND TO THE INVENTION

I. Field of the Invention

The present invention concerns a self stowable rack, useful for drying pasta, which can be mounted as a fixture in a kitchen; it also concerns the mounted rack, and a method of drying pasta.

II. Known Art and Problems

Various rack contrivances are known, among which include those particularly adapted for drying pasta and those adapted for other uses. See, Duggan, U.S. Pat. Des. No. 267,768; Dahlquist, U.S. Pat. No. 5,105,954; Wilhite, U.S. Pat. No. 5,167,329; Raye, Sr., U.S. Pat. No. 5,213,221; and Chef's Catalog, 1998, page 73, "The Best Pasta Drying Rack!"

The foregoing represent free standing racks. Unfortunately, when in use in the kitchen, such racks take up valuable counter space, and when not in use, such racks present a separate stowage problem. Another difficulty encountered with the use of such racks is that pasta noodles when cut, particularly when cut by a kitchen pasta machine, must be handled to put the noodles on the rack to dry. This manual operation often results in clumping, which, if the noodles are to dry properly, separate one from another, requires another step of separation of the clumped noodles, which may be a "sticky" problem to overcome.

It would be desirable to ameliorate if not overcome such problems. It also would be desirable to do so with simplicity.

SUMMARY OF THE INVENTION

The present invention provides a rack comprising a mountable base member; at least one pivoting member connected to said base member and dependable therefrom, said at least one pivoting member being elongate with two opposing ends, about a first opposing and of which is pivotable with respect to said base member; and a service member connected to said at least one pivoting member at a point away from said first opposing end. Also provided are the rack mounted as a fixture, particularly in a kitchen, and a method of drying pasta comprising providing a supply of raw pasta noodles, said supply being a plurality of the noodles generally parallel one to another; inserting a pasta rack dowel under said supply; lifting said supply with said dowel, and securing the same by a dowel retaining feature on a service member of a pasta drying rack.

The rack is useful for drying pasta.

Significantly, by the invention, problems in the art are ameliorated if not overcome. The invention provides a rack which may be used for drying pasta noodles, which can be mounted as a fixture in the kitchen. As such, when in use, it does not take up counter space because it has no requirement that it stand on a counter. It is self stowable, particularly when mounted as the fixture. The rack is simple in construction, and efficient to make and use. Practice of the instant method avoids clumping.

Numerous further advantages attend the invention.

THE DRAWINGS IN BRIEF

The drawings form part of the specification hereof. With respect to the drawings, the following is briefly noted:

ILLUSTRATIVE DETAIL

The invention can be further understood by the present detail, which may be read in view of the drawings. Such is to be taken in an illustrative and not necessarily limiting sense.

Figure 1:
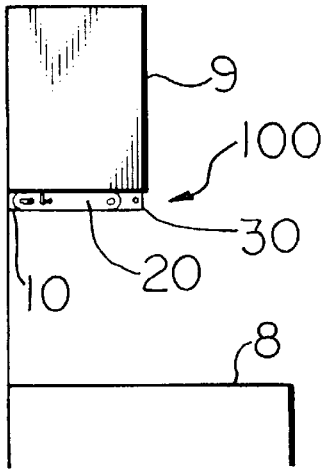
FIG. 1 is a side plan view of a rack of the present invention, suitable for use in drying pasta, mounted as a fixture to the underside of a cabinet in a kitchen, in stowage position.
Figure 2:
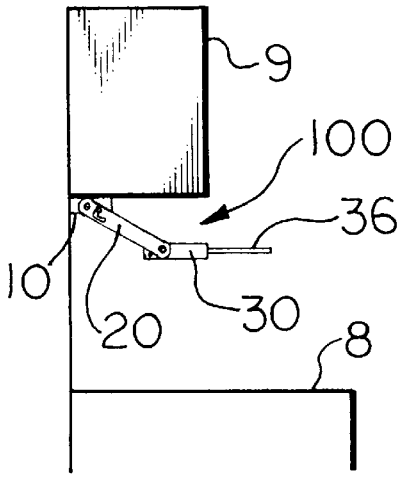
FIG. 2 is a side plan view of the mounted rack of FIG. 1, in a position to dry pasta.

With respect to the drawings, above a kitchen counter 8 and underneath a kitchen cabinet 9, pasta drying rack 100 may be mounted (FIGS. 1 & 2) in any suitable manner such as by screws, nails, rivets, staples, clips, straps, wires, press fitting, gluing, welding, magnetic forces, and so forth and the like, particularly about mountable base member 10 of the rack 100. In addition to the mountable base member 10, which preferably is elongate in nature, the rack 100, in general, has elongate pivoting members 20, each of which are connected to and pivotably dependable from the base member 10 about a first opposing end of the member 20; and service member 30 which is connected to the pivoting members 20 at a point away from the first opposing end of the members 20.

Figure 3:
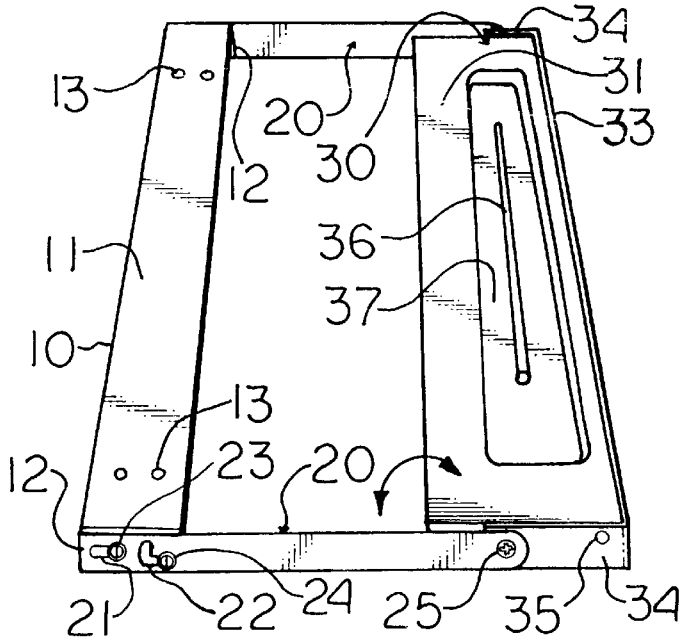
FIG. 3 is a perspective view of the rack of FIGS. 1 & 2, not mounted, and in a retracted, stowage position.
Figure 4:
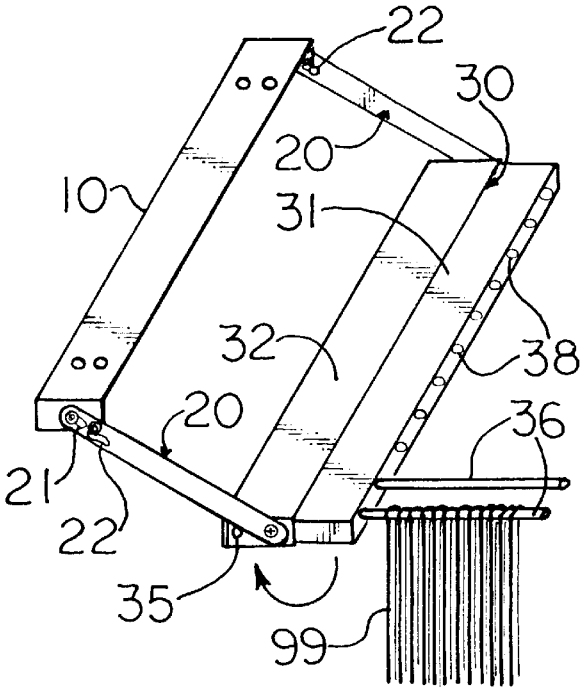
FIG. 4 is a perspective view of the rack of FIG. 3, in a position to dry, and drying, pasta noodles.

With more particularity (FIGS. 3 & 4) the mountable base member 10 may be elongate and include pivoting member spreading portion 11, pivot member receiving faces 12, and fixture-mounting accommodations such as holes 13 through which a suitable fastener may pass to mount the rack 100. The at least one elongate pivoting member may come as a plurality of elongate pivoting members 20 such as in a complementary pair, each having a first end, for example, with a set of sliding, pivoting slots 21 & 22, into which may be accommodated pivot post 23 & 24, respectively, and a second, opposing end having a pivot hole (not illustrated) into which may be accommodated another pivot post 25. The slot 21, closer to the first end, may be a simple straight slot which runs parallel to the axis of elongation of the member 20, and the slot 22, somewhat distant to the first end, may be L-shaped. When the rack 100 is in stowage position (FIGS. 1 & 3) the pivot posts 23 & 24 occupy positions in the slots 21 & 22 which are closer or as close as possible to the second opposing end of the member 20; when the rack 100 is in a partially pulled out or partially stowed position (not illustrated) the pivot posts 23 & 24 occupy positions in the slots 21 & 22 which are farther or as far as possible from the second opposing end of the member 20, with the pivot 24 in the corner of the L-shaped slot 22; and when the rack 100 is in a depending position (FIGS. 2 & 4) the pivot posts 23 & 24 occupy positions in the slots which are farther or as far as possible from the second opposing end of the member 20, with the pivot 24 in the uppermost part of the L-shaped slot 24. Although the employment of the slots 21, 22 is preferred in the practice of the invention, other means of having the rack of the invention be presented in a depending position may be employed; for instance, a spring and/or elongate member retaining string or other line arrangement may be employed, and so forth and the like. The service member 30 may be connected to one or more pivoting member(s) about the second end of the member(s) 20 (FIGS. 1–4) or at some point closer to the first end of the member(s) 20, and, in the latter case, the second end of the member(s) may be provided with or employed as a handle to accomplish or assist in accomplishing rack movement to stowage and service positions. Preferably, the service member 30 is forwardly and reversedly pivotable about the pivot 25 on the elongate pivoting member 20 (FIGS. 3 & 4). However, it need not be pivotable, for instance, being rigid and having pasta dowel retaining features at a predetermined position on the service member such as at an angle which would provide for horizontal pasta dowel positioning; such a nonpivotable service member may be made of a simple cylindrical rod or boxlike piece which may be hollow and accessible at the end(s) thereof for storage and retrieval of pasta dowels. The pivotable service member 30 (FIGS. 1–4) may include elongate service support member 31, for example, with a length about the same as that of the mountable base member 10, and auxiliary support sheathing, bottom 32, front 33, and side 34. Service member pivot stop 35, for example, a protruding dimple or bump (FIGS. 3 & 4) or an inserted post, screw or She like, extends from the surface of the side 34 and restricts the range of rotation of the rotating service member 30 to a position where, when the rack 100 is in a depending service position (FIGS. 2 & 4), the stop 35 comes into contact with the elongate member 20 at a point which assures that the service member 30 is horizontally positioned. The pivoting service member 30 may also include a supply of removable, portable pasta holding dowels 36, which may be stored in dowel tray 37; and a series of pasta dowel retaining features, for example, holes 38, or other suitable construction such as a sleeve or pocket, VELCRO (Reg. U.S. Pat. & Tm. Off.) hook and loop material, magnets, and so forth. The dowels 36 are conveniently cylindrical but may be of any suitable shape such as with another curvilinear type cross section or a polygonal cross section to include triangle, square, rectangle, pentagonal, and so on, and are conveniently straight, but may be curved if desired. When the rack 100 with the pivoting service member 30 is in the stowage position, the dowel tray 37 and dowel retaining feature holes 38 are hidden from normal view; in the depending, prepatory position, before the rotating service member is rotated to expose the holes 38 to the front, the dowel tray 37 is readily accessible to remove the dowels 36; in the depending, service position, the dowel tray 37 is turned upside down, and the holes 38 face to the front to conveniently receive the pasta dowels 36, which have pasta 99 thereon to dry.

The rack is made of any suitable material(s). For example, in the rack 100 the mountable base member 10 may be made of metal to include stainless steel or be made of other suitable material such as plastic or wood; the elongate pivoting member(s) 20 may be made of metal to include stainless steel or be made of another suitable material such as plastic or wood; the service member 30 may be made of wood or other material such as plastic or metal, say, for the member 31, and optionally have metal to include stainless steel peripheral portions 32, 33 & 34 and pivot stop(s) 35, with the dowels 36 of wood or other suitable material such as plastic or metal. Fasteners, to include, for example, screws to mount the rack 100 as a fixture, say, in the kitchen, to a wall or the underside of the cabinet 9, and to serve as the pivot posts 23, 24 & 25, may be made of any suitable material such as metal to include stainless steel and so forth. Flat head type screws are desirably employed.

Figure 5:
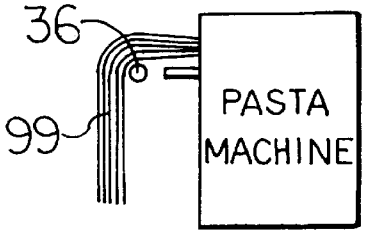
FIG. 5 is a side plan view of a step in the method of the invention, with a pasta dowel in position to lift pasta noodles.

Beneficially in the practice of the method of the invention, a free pasta dowel 36 can be inserted under a supply of raw pasta noodles 99 such as may exit from a pasta machine (FIG. 5). The dowel 36 is positioned about midpoint of the length of the noodles 99 to be cut, and, when they are cut, the pasta noodles 99, not having been touched by hand, hang over the dowel 36; the dowel can be inserted in the rack 100 through a hole 38, and the supply of pasta noodles 99 can dry in the rack 100 (FIG. 4). As an alternative, the method may be applied to another rack, even a free standing rack which otherwise has a pasta dowel retaining feature for a free pasta dowel, so long as the pasta is handled in the same general manner as mentioned above.

CONCLUSION

The present invention is thus provided. Various features, parts, subcombinations and combinations of the invention may be practiced with or without regard to other of its features, parts, subcombinations or combinations, and numerous adaptations and modifications can be effected within its spirit, the literal claim scope of which is particularly pointed out as follows:

I claim:

1. A rack useful for drying pasta, which comprises a mountable base member; at least one pivoting member connected to said base member and dependable therefrom, said at least one pivoting member being elongate with two opposing ends, about a first opposing end of which is pivotable with respect to said base member; and a service member connected to said at least one pivoting member at a point away from said first opposing end.

2. The rack of claim 1, wherein the at least one pivoting member comprises a pair of complementary pivoting members mounted on opposing ends of each of said base and service members.

3. The rack of claim 2, wherein each pivoting member is elongate with two opposing ends and has a pair of slots by a first opposing end thereof, through each slot there being a pivot post, one of the pair of slots closer to the first opposing end being generally parallel to an axis of elongation of the pivoting member, and the other of the pair of slots further from the first opposing end thereof being L-shaped.

4. The rack of claim 3, wherein the service member is forwardly and reversedly pivotable between the pair of pivoting members.

5. The rack of claim 4, wherein the service member includes a pivot stop which restricts the pivoting motion of the service member by contact with at least one of the pivoting members.

6. The rack of claim 5, wherein the service member includes a series of pasta holding dowel retaining features.

7. The rack of claim 6, wherein the pasta holding dowel retaining features are holes; pasta holding dowels are present, with the pasta holding dowels being portable, and a pasta holding dowel tray is present in the service member.

8. The rack of claim 1, wherein the service member includes a series of pasta holding dowel retaining features.

9. The rack of claim 8, wherein the pasta holding dowel retaining features are holes; pasta holding dowels are present, with the pasta holding dowels being portable, and a pasta holding dowel tray is present in the service member.

10. In combination, a rack useful for drying pasta, which comprises a mountable base member; at least one pivoting member connected to said base member and dependable therefrom, said at least one pivoting member being elongate with two opposing ends, about a first opposing end of which is pivotable with respect to said base member; and a service member connected to said at least one pivoting member at a point away from said first opposing end; and an article to which the rack is mounted and affixed.

11. The combination of claim 10, wherein the article is a kitchen cabinet, and the rack is mounted on an underside thereof.

12. The combination of claim 11, wherein the at least one pivoting member comprises a pair of complementary pivoting members mounted on opposing ends of each of said base and service members.

13. The combination of claim 12, wherein each pivoting member is elongate with two opposing ends and has a pair of slots by a first opposing end thereof, through each slot there being a pivot post, one of the pair of slots closer to the first opposing end being generally parallel to an axis of elongation of the pivoting member, and the other of the pair of slots further from the first opposing end thereof being L-shaped.

14. The combination of claim 13, wherein the service member is forwardly and reversedly pivotable between the pair of pivoting members.

15. The combination of claim 14, wherein the service member includes a pivot stop which restricts the pivoting motion of the service member by contact with at least one of the pivoting members.

16. The combination of claim 15, wherein the service member includes a series of pasta holding dowel retaining features.

17. The combination of claim 16, wherein the pasta holding dowel retaining features are holes; pasta holding dowels are present, with the pasta holding dowels being portable, and a pasta holding dowel tray is present in the service member.

18. The combination of claim 10, wherein the service member includes a series of pasta holding dowel retaining features.

19. The combination of claim 18, wherein the pasta holding dowel retaining features are holes; pasta holding dowels are present, with the pasta holding dowels being portable, and a pasta holding dowel tray is present in the service member.

20. A method of drying pasta, which comprises providing a supply of raw pasta noodles, said supply being a plurality of the noodles generally parallel to one another; inserting a pasta rack dowel under said supply; lifting said supply with said dowel, and securing the same by a dowel retaining feature to a service member of a pasta drying rack.

* * * * *